United States Patent [19]

Kennedy et al.

[11] Patent Number: 4,947,751

[45] Date of Patent: Aug. 14, 1990

[54] MULTI-DIRECTIONAL INITIATOR FOR EXPLOSIVES

[75] Inventors: David L. Kennedy, Rosanna, Australia; Donald C. True; David M. Welsh, both of Brownsburg, Canada

[73] Assignee: Imperial Chemical Industries, PLC, London, England

[21] Appl. No.: 305,922

[22] Filed: Feb. 3, 1989

[30] Foreign Application Priority Data

Feb. 3, 1988 [GB] United Kingdom ..... 8802328

[51] Int. Cl.[5] ..... F42B 3/10; C06C 5/04

[52] U.S. Cl. ..... 102/305; 102/304; 102/318; 102/331

[58] Field of Search ..... 102/313, 315, 320, 322, 102/331, 332, 305, 301, 275.11, 275.12

[56] References Cited

U.S. PATENT DOCUMENTS

| | | | |
|---|---|---|---|
| 2,775,940 | 1/1957 | Klotz | 102/313 |
| 3,236,180 | 2/1966 | Towle | 102/332 |
| 3,280,743 | 10/1966 | Reuther | 102/305 |
| 4,109,575 | 8/1978 | Hashimoto | 102/305 |
| 4,270,455 | 6/1981 | Janoski | 102/318 |
| 4,334,476 | 6/1982 | Day et al. | 102/331 |
| 4,350,097 | 9/1982 | Bowman et al. | 102/331 |
| 4,425,849 | 1/1984 | Jorgenson | 102/304 |
| 4,425,850 | 1/1984 | Grössler | 102/331 |

*Primary Examiner*—David H. Brown

*Attorney, Agent, or Firm*—Cushman, Darby & Cushman

[57] ABSTRACT

A method of blasting cap-sensitive, non-nitroglycerine-sensitized explosives and an initiating assembly for use in the method are provided. The method comprises initiating a column of the explosives by directing two radial/forward shock forces from an initiator assembly substantially simultaneously along the column of the explosives towards each end of the column. The initiating assembly of the invention comprises at least two initiators assembled side-by-side so that their explosive ends are opposite. A moulded plastics holder (6) for holding two blasting caps (1, 8) in the required spatial relationship is also described.

2 Claims, 2 Drawing Sheets

MULTI-DIRECTIONAL INITIATOR FOR EXPLOSIVES

This invention relates to the art of blasting with explosives. More particularly, the invention relates to a method of detonating a column of cap-sensitive explosives of the emulsion and water gel type or the pneumatically-loaded ANFO type wherein the explosive charge confined in a borehole is fully initiated so that no desensitization of the explosive column takes place or no partly consumed or unconsumed explosive remains in the borehole.

The invention also includes an initiator assembly for use in the said method and to a moulded plastics holder for use in the said assembly.

With the advent of Nobel's Safety Powder or Dynamite, a practical means was provided to harness the energy of nitroglycerine. There remained a need for a practical and safe means for initiating the newly-discovered dynamite. While dynamite could usually be detonated under confinement by a spark or by a tube of gun powder, these methods were generally not satisfactory. The problem was solved by Nobel's invention of the blasting cap. He made use of the property of primary explosives, such as mercury fulminate, to detonate upon being heated and their ability to detonate a secondary explosives, such as dynamite, placed adjacent thereto.

The construction and use of blasting caps has remained substantially unchanged since their invention by Nobel in the late 1860's and blasting caps, in one form or another, remain the principal device by which both sensitive and non-sensitive explosives are initiated.

As demonstrated by C. H. Johansson and P. A. Persson in the text "Detonics of High Explosives" (Academic Press, London and New York), the detonation of a blasting cap scatters metal fragments radially from its sides and axially forward from the end of the casing containing the base charge of explosives. The detonation of the cap thus produces a radial and forward high energy shock force and shows little detonation in the direction of the non-explosive end of the cap casing. When a blasting cap is employed to initiate a dynamite cartridge, whether by being placed adjacent the dynamite cartridge or being inserted within the dynamite cartridge, little account need be taken of the radial and forward shock action of the blasting cap detonation. This is because the sensitivity of the nitroglycerine content of the dynamite is normally sufficient that, once initiated, the dynamite cartridge achieves very rapid detonation velocity in all directions along the axial length of the cartridge. An exception may be nitroglycerine-sensitized permitted explosives wherein the nitroglycerine content is minimized. A column of dynamite confined in a borehole can be initiated from a blasting cap placed mid-way along the length of the confined charge and, when detonated, the blasting cap, in turn, initiates the centre of the column of the dynamite charge which initiation provides full detonation of the dynamite charge in both directions away from the blasting cap. There is, in other words, sufficient chemical reaction induced immediately adjacent to the explosive end of the blasting cap that the detonating wave within the column of dynamite is self-propagating in all directions. Even in situations where a full order detonation velocity is not achieved in a dynamite column, there is, nevertheless, sufficient energy release to consume substantially all of the explosives in the borehole leaving no residue within the hole which may constitute a hazardous situation. However, the very nature of dynamite explosives and their ability to self-propagate at low energy levels constitutes a safety hazard since they are, by their very nature, more sensitive to impact and friction and, consequently, must be handled with extreme care.

More recently, sensitive nitroglycerine-type explosives have been replaced in large measure by impact and friction insensitive explosives of the water gel or emulsion types or by ammonium nitrate/fuel oil (ANFO) explosives which are pneumatically charged into boreholes. These latter compositions, while initiable by blasting cap, are resistant to initiation by friction or impact. However, the very nature of their insensitivity results in difficulty in initiating these explosives to sustained high order detonation along the column. When initiated by a blasting cap, a confined column of water gel or emulsion explosives, particularly in small diameter sizes, tends to propagate at a full order detonation mainly in the direction of the radial/axial shock force delivered from the explosive end of the blasting cap. Any explosives in the column remote from the radial/axial end of the blasting cap generally cannot sustain a full order detonation and can, in some instances, remain unconsumed in the borehole. Indeed, the explosive remote from the radial/axial end of the cap becomes merely compressed or densified and thus is rendered more insensitive. In this condition, the densified explosive is unable to sustain self-detonation. The resulting unconsumed explosive remaining in the working rock constitutes a safety hazard in subsequent drilling operations.

It has been suggested that the problem of lack of reverse initiation in blasting caps might be overcome by employing caps of increased strength, that is, by providing a larger or more powerful charge of the conventional explosives within the cap casing. It can be shown, however, that use of such a higher strength cap tends merely to increase the duration of the pressure pulse in the reverse direction without any substantial increase in intensity of the pulse. This action serves only to desensitize more of the explosives in the borehole and so exacerbates the problem.

It is desirable, therefore, to provide a method of blasting with small diameter, cap-sensitive water gel; emulsion and ANFO explosives to provide an initiating system whereby full order detonation is achieved in all directions along the column of explosives in the borehole.

Accordingly, it is an object of the invention to provide a method of detonating a column of cap-sensitive emulsion, water gel or pneumatically-loaded ANFO explosives confined in a borehole such that uniform propagation of full order detonation of the explosives proceeds in all directions sumultaneously.

It is a further object of the invention to provide an assembly of initiating devices for use in performing such a method, and it is still a further object of the invention to provide a means for conveniently retaining a plurality of initiators constituting such an assembly in the required spatial relationship.

In accordance with the present invention, there is provided a method of detonating a confined column of water gel, emulsion or pneumatically-loaded ANFO cap-sensitive explosives, which method comprises initiating the said column of explosives in a manner such as to provide a sustained full order uniform velocity detonation wave from the point of initiation simultaneously towards both ends of the said column. The required detonation wave may be provided by initiating the column by means of an assembly of blasting caps or similar initiators, which when initiated, delivers a detonating impulse longitudinally along the column of explosives, simultaneously in both directions.

A preferred initiator assembly for performing the method comprises, for example, two blasting caps each containing an ignition charge of primary explosives material and a base charge of secondary explosives material said caps being secured together side-by-side such that the base charge end of the first cap is at one end of the assembly and the base charge end of the second cap is at the opposite end of the assembly and the ignition charges are co-incident over a portion of the length of the assembly so that initiation of the ignition charge of the first cap causes simultaneous initiation of the ignition charge in the second cap. By the initiation of one of the caps in the assembly, the adjacent second cap will be substantially simultaneously detonated and the detonation of the assembly will provide nearly equal and opposite radial/forward shock forces of initiating energy in both the north and south directions along the column.

The caps of the assembly may be secured together, for example, by common friction tape. Alternatively, a moulded holder of plastics or similar material may be constructed to retain the caps in side-by-side, north-/south contact.

For a better understanding of the method of the invention and its operation, reference should be made to the accompanying drawing and descriptive matter in which one embodiment of the invention is described, by way of example.

Figure 1:
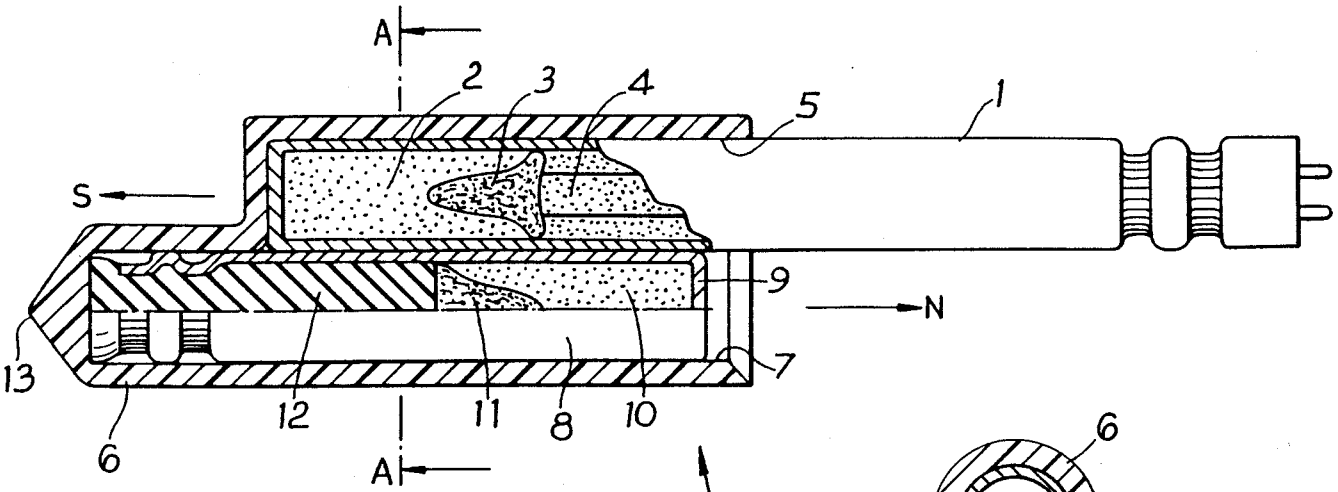
FIG. 1 is a vertical sectional side view of a holder device, for use in performing the method of the invention, adapted to hold two caps in side-by-side alignment.
Figure 2:
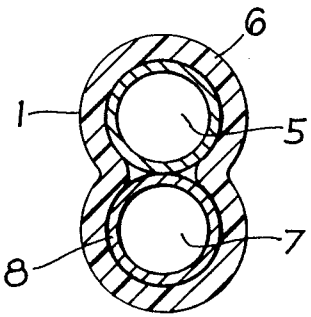
FIG. 2 is a cross-section of the holder and caps of FIG. 1, taken along the line A—A.

In the Figures, parts corresponding to each other have been given the same reference designations.

Referring to the drawings, numeral 1 designates a conventional, electric or non-electric delay blasting cap having an external metal shell. Within the shell is a base charge 2 of secondary explosives material, for example, PETN, an ignition charge 3 of primary explosives material, for example, lead azide, and a delay train 4 abutting the ignition charge 3. Blasting cap 1 is inserted into an upper substantially cylindrical tunnel or chamber 5 of a moulded plastic carrier 6. Carrier 6 which, in the embodiment depicted has a generally FIG. 8 configuration when viewed in transverse cross-section, comprises said upper chamber or tunnel 5 and a similar lower chamber or tunnel 7, which in use contains a modified blasting cap or initiator 8. Initiator 8 comprises a metal shell 9 containing a base charge 10 of, for example, PETN and an ignition charge 11 of, for example, lead azide. The remainder of the interior of shell 9 is occupied by a plastic or rubber stopper 12. Initiator 8 is inserted into the lower tunnel or chamber 7 so that its base charge 10 is outermost, that is, the base charge 10 points in a "northerly" direction while the base charge of blasting cap 1 within tunnel 5 is inserted so that its base charge 2 is pointed in a "southerly" direction. Moulded plastic container 6 may advantageously be constructed so as to have a pointed end portion 13 which end portion aids in the penetration of a package containing a water gel or emulsion explosives and allows the assembly close contact with the explosive material therein.

Figure 3:
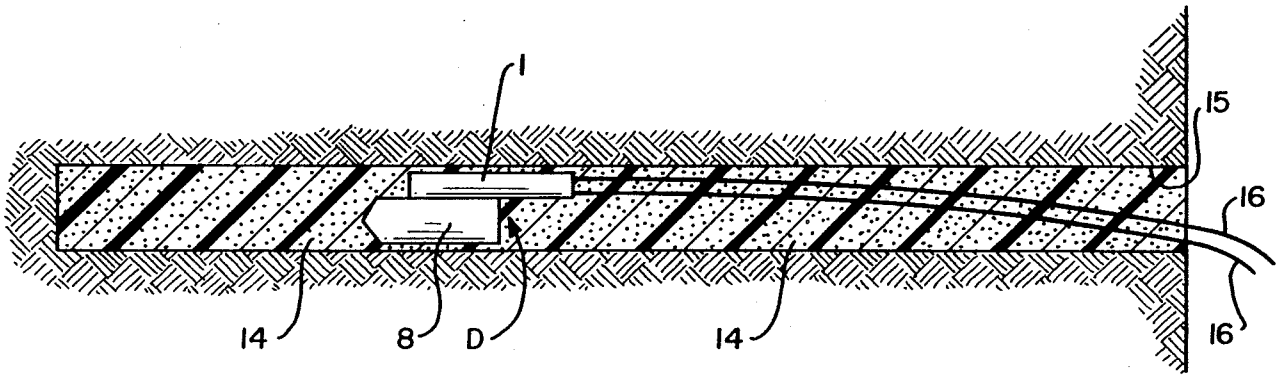
FIG. 3 is a schematic diagram showing the use of the device of FIG. 1 in a borehole.

In use in the field, where, for example, a borehole having a depth of, say, 10 feet and a diameter of two inches, is to be detonated, the method of the invention may be employed as follows. Packaged emulsion explosive cartridges having an outside diameter of about two inches are first inserted into the borehole until the borehole is approximately one-half filled with explosives. A single cartridge of the explosives may then be prepared by inserting therein the blasting cap carrier containing the caps 1 and 8 as depicted in FIG. 1. Blasting cap 1 has attached thereto either electric lead wires or a non-electric initiating fuse of sufficient length to reach the mouth of the borehole. The thus primed cartridge is inserted into the borehole until it contacts the already half-filled explosives therein. The remainder of the borehole may then be charged with further two inch diameter explosive cartridges and the mouth of the borehole sealed as is customary in the art. Upon detonation of blasting cap 1, substantially simultaneous detonation of blasting cap 8 occurs. The energy from blasting cap 1 is directed substantially downwardly towards the foot of the borehole while the energy from blasting cap 8 is directed substantially upwardly towards the mouth of the borehole. The explosives charge in the borehole is, thus, initiated simultaneously at a high velocity rate in all directions, thus achieving a maximum output of explosive energy and a minimum residue of unexploded material in the borehole. The above described use of the device D of FIG. 1 comprising blasting caps 1 and 8 is shown in FIG. 3 where the numeral 14 represents a column of cap-sensitive water-gel, emulsion or pneumatically-loaded ANFO explosive in borehole 15. The cap 1 may be detonated by leads 16 with substantially simultaneous detonation of blasting cap 8.

We claim:

1. A method of detonating a column of cap-sensitive water-gel, emulsion or pneumatically-loaded ANFO explosive so as to provide a sustained full order uniform velocity detonation wave in the column from the point of initiation substantially simultaneously towards both ends of the column, said method comprising locating a plurality of initiators at a selected point within said column, the initiators being oriented in different directions towards opposite ends of the column, and detonating the initiators substantially simultaneously.

2. A method as claimed in claim 1 which comprises utilizing two blasting caps, each containing an ignition charge of primary explosive and a base charge of secondary explosive, as the initiators, the two caps being held in close proximity to one another with their ignition charges side-by-side and their base charges directed at opposite ends of the column, and remotely initiated one cap so that its initiation effects substantially simultaneous detonation of the other cap.

* * * * *